United States Patent [19]

Allsop

[11] 4,190,166

[45] Feb. 26, 1980

[54] SKI POLE MOUNTING ASSEMBLY AND METHOD

[76] Inventor: James D. Allsop, 2144 Dellesta Dr., Bellingham, Wash. 98225

[21] Appl. No.: 887,806

[22] Filed: Mar. 17, 1978

[51] Int. Cl.[2] ..... A47F 7/00

[52] U.S. Cl. ..... 211/60 R; 211/60 SK; 211/162

[58] Field of Search ..... 211/60 R, 60 SK, 162, 211/151

[56] References Cited

U.S. PATENT DOCUMENTS

| | | | |
|---|---|---|---|
| 3,351,210 | 11/1967 | Murcott | 211/60 R X |
| 3,456,806 | 7/1969 | Borston | 211/60 R |

FOREIGN PATENT DOCUMENTS

| | | | |
|---|---|---|---|
| 822709 | 10/1951 | Fed. Rep. of Germany | 211/60 R |

*Primary Examiner*—Roy D. Frazier
*Assistant Examiner*—Robert W. Gibson, Jr.

[57] ABSTRACT

A plurality of platforms mounted for limited longitudinal movement on a base member. Each platform has pairs of mounting socket members to receive tips of ski poles therein, the mounting members being arranged in two transverse rows, with alternate pairs of mounting members being at an upper level, and intermediate pairs of mounting members being at a lower level. The mounting sockets are placed sufficiently close to one another so that the baskets at the tip ends of adjacent ski poles overlap one another. In spite of this overlap, any set of ski poles can be removed from the mounting device without interference from the overlapping baskets of adjacent ski poles, because of a staggered relationship of the upper and lower pairs of mounting members between adjacent rows.

39 Claims, 8 Drawing Figures

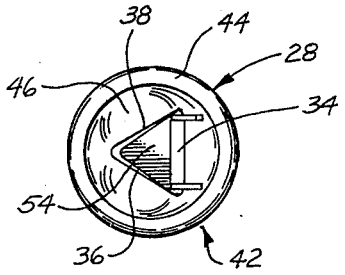
FIG. 6
FIG. 7
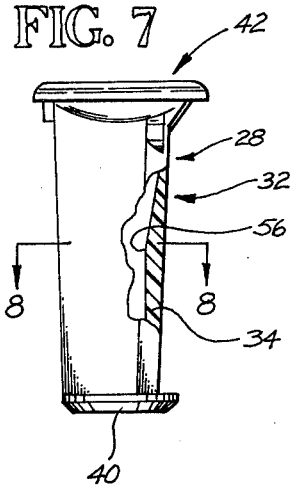
FIG. 8
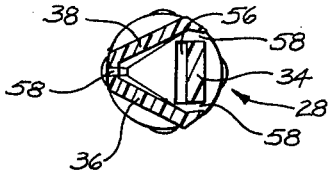

SKI POLE MOUNTING ASSEMBLY AND METHOD

BACKGROUND OF THE INVENTION

A. Field of the Invention

The present invention relates to a display device particularly adapted for mounting pairs of ski poles in closely spaced relationship, and a method for the same. In the following description this will be referred to as a "ski pole mounting" device or assembly.

B. Brief Description of the Prior Art

One of the problems in ski shops is the placing of ski poles in a manner that the ski poles are readily accessible. A ski pole is commonly made up of an elongate pole portion having a handle at the upper end, and a basket adjacent the tip end of the pole. If the poles are stored too closely together, the baskets of several pairs of ski poles often overlap one another so that it's quite often necessary to move several pairs of poles to free one pair from the group of poles.

Conventional storage racks quite often store poles in several rows, with the rows being spaced a sufficient distance from one another to permit easy access to a pair of ski poles and easy removal of the poles. While such mounting devices are workable, when a large number of ski poles are stored, a relatively large amount of floor space is required.

Accordingly, it is an object of the present invention to provide a ski mounting device where pairs of ski poles can be mounted relatively close to one another with the baskets in overlapping relationship, and yet have the pairs of ski poles arranged so that they can be conveniently removed from the mounting device without interference from the other pairs of poles. It is also an object to provide a method of accomplishing the same.

SUMMARY OF THE INVENTION

In the mounting assembly of the present invention a plurality of groups of pairs of ski poles are mounted to a plurality of platform members which are in turn mounted to a base member for limited movement thereon along the longitudinal axis of the base member. Each of the ski poles has a main pole portion, a basket at the lower end of the pole portion, and a tip portion extending downwardly from the basket, and the basket of each pole having a predetermined radius and diameter, and the pole tip of each having a predetermined length.

Each mounting platform has its own longitudinal axis parallel to the base member longitudinal axis, and a lateral axis generally transverse to its longitudinal axis. Each mounting platform has a plurality of mounting members, each of which has an upper end with an upwardly facing mounting socket of a predetermined depth dimension to receive therein a tip portion of a pole. The pairs of mounting members are arranged in at least one transverse row made up of alternate pairs of mounting members and intermediate pairs of mounting members positioned intermittently with the alternate pairs of that row. In the preferred form, there are two transverse rows, and the alternate pairs of mounting members of the first row are arranged in staggered relationship with the alternate pairs of the second row, and the intermediate pairs of the first row are in staggered relationship with the intermediate pairs of the second row.

The mounting members of each platform are arranged is generally longitudinal and transverse alignment. Each of the mounting members is spaced from adjacent aligned mounting members by a distance greater than the radius of the baskets and less than the diameter of the baskets. The alternate pairs of mounting members have their upper ends at a first upper level above the platform, and the intermediate pairs of mounting members have their upper ends at a second lower level. The upper and lower levels are spaced from one another a vertical distance such that the vertical dimension from a basket of a pole mounted in one of the upper mounting members to an upper end of an adjacent lower mounting member is at least as great as the distance from the upper side of a basket of a pole to the tip thereof.

With this arrangement of the mounting assembly, ski poles in adjacent and aligned mounting members have their baskets in overlapping relationship, with poles in alternate mounting members being able to be moved upwardly free of their mounting members without interference from baskets of adjacent poles. The poles mounted in the intermediate mounting members can be removed by being moved upwardly free of their related lower mounting members, without interference from baskets in adjacent aligned mounting members of the alternate pairs. The poles are then moved longitudinally relative to the platform to be free of the mounting assembly.

Desirably, the mounting members of each pair are spaced longitudinally from one another. Also, the preferred manner of mounting the platform members to the base is such that two adjacent platform members can be moved longitudinally from one another so that adjacent mounting members of the two platform members are spaced from one another at least a distance equal to approximately twice the diameter of the baskets of the poles.

In its preferred form, adjacent rows of mounting members from two adjacent platform members are arranged with the alternate pairs of mounting members of one of the adjacent rows being in staggered relationship with the alternate pairs of mounting members of the other adjacent row. In like manner, the intermediate pairs of mounting members of these adjacent rows are also in staggered relationship.

In the preferred embodiment, the alternate mounting members are in the form of studs upstanding from an upper surface of the platform, and the intermediate mounting members are in the form of studs extending downwardly from the upper surface of the platform. Further, in the preferred form, each of the mounting members comprises a socket portion made up of a plurality of vertically aligned generally planar walls adapted to grip a related pole tip along its length. One of the walls has an inwardly protruding portion to press that pole tip against the other walls. As shown herein, each socket member has three such walls, positioned adjacent one another in a generally triangular configuration. Two of the walls have a generally planar configuration to engage the tip, and the other wall is provided with the inward protrusion. To provide the proper resiliency of the walls, the three walls are joined together at upper and lower ends, and form spacing slots between the walls to permit yielding movement of the walls in engaging the tip portion of the ski pole.

To describe the apparatus of the present invention in other terms, there are two sets of mounting members which are mounted to a mounting platform. Each mounting member has an upper end with an upwardly facing mounting socket of a predetermined depth dimension to receive therein a tip of a pole. The mounting member of the first set have their upper ends at a first upper level above the platform, and the mounting members of the second set have their upper ends at a second lower level. The upper and lower levels are spaced from one another by a vertical distance such that the vertical dimension from a basket of a pole mounted in one of said upper mounting members to an upper end of an adjacent lower mounting member is at least as great as the distance from the upper side of a basket of a pole to the tip thereof.

The mounting members are arranged in two generally parallel rows, with the mounting members of the first and second sets being positioned in each row alternately with one another along the length of the row. In the preferred form the mounting members of the first set are in staggered relationship with one another along the length of the two rows, and the mounting members of the second set are likewise in staggered relationship with one another along the length of the two rows.

Also, the mounting members are arranged in generally longitudinal and transverse alignment, with each of the mounting members being spaced from adjacent aligned mounting members by a distance greater than the radius of the baskets and less than the diameter of the baskets.

In the method of the present invention, the ski poles are mounted in socket-like mounting members in generally the same arrangement and spacing as described previously with respect to the apparatus of the present invention. Poles in the mounting members located at the upper level are removed from their mounting members simply by moving these poles upwardly, without interference from baskets of adjacent poles. The poles mounted in the mounting members located at the lower level are removed from the other poles by moving these poles upwardly free of their related lower mounting members, without interference from baskets in adjacent aligned mounting members at the upper level, and then moving these poles longitudinally relative to the remaining poles.

Where a plurality of groups of poles are arranged on two or more mounting platforms movable with one another, as part of the process of removing the poles from the mounting members at the lower level, two adjacent mounting platforms are spaced from one another to permit the poles to be moved free of their group of poles into an open area between the two spaced mounting platforms.

Other features of the present invention will become apparent from the following detailed description.

BRIEF DESCRIPTION OF THE DRAWING

FIG. 6 is a top plan view of one of the socket members which are employed in the present invention to receive the tips of the ski poles being mounted in the platforms, this socket member being shown removed from its related mounting platform;

FIG. 7 is a side elevational view of the socket member of FIG. 6; and

FIG. 8 is a sectional view taken along line 8—8 of FIG. 7.

DESCRIPTION OF THE PREFERRED EMBODIMENT

Figure 5:
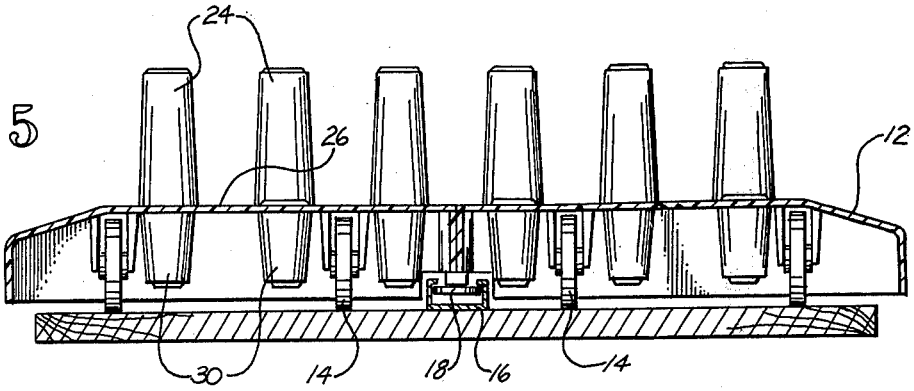
FIG. 5 is a sectional view taken along line 5—5 of FIG. 2.

The mounting assembly of the present invention comprises a generally rectangularly shaped planar base member 10, having a longitudinal axis parallel to its lengthwise dimension, and a transverse axis crossing the longitudinal axis. A plurality of mounting platforms 12 are mounted to the upper surface of the base member 10 for limited longitudinal movement thereon. The particular method of mounting is done in a somewhat conventional manner by use of underlying rollers, as shown in FIG. 5. Specifically, each platform 12 has six rollers 14 mounted for rotation about transverse horizontal axes to bear against the underlying base member 10.

Extending along the longitudinal center line of the base member 10 is a rail member 16, having a cross-sectional configuration of an upturned "U" shaped channel member. Each platform 12 has at its longitudinal center line a pair of longitudinally spaced tracking members 18 which engage the rail member 16. Thus, each platform 12 can roll over the upper surface of the base member 10, with the tracking members 18 limiting such travel to movement along the longitudinal axis of the base member 10.

The length of the base member 10 and its rail member 16 (i.e. the dimension parallel to the longitudinal axis) is made moderately larger than the combined longitudinal length of the platforms 12 mounted thereon, to permit limited longitudinal movement of the platforms 12. The purpose of this is to permit easy removal of the ski poles from the platform, and this will be discussed in detail later herein. The lateral portions of each platform 12 are provided with upwardly facing friction pads 20 which permit a person to utilize his or her foot or some device to engage the platform 12 and shift it longitudinally over the base 10.

Of particular significance in the present invention is the spacing and arrangement of the mounting members on the platform 12. For each platform 12, there are two sets of pairs of mounting members, namely pairs of upper mounting members **22*a*, and pairs of lower mounting members 22*b***.

Each upper mounting member **22*a* comprises an upstanding stud member 24 extending above the upper surface 26 of the platform 12, and having an upwardly facing opening in which is inserted a socket member 28. Each lower mounting member 22*b* is provided with a lower stud 30 extending downwardly from the platform upper surface 26, with each lower stud 30 also having an upwardly facing opening at the location of the platform surface 26. The identical socket member 28 which is used in the upstanding studs 24 is also employed with the lower studs 30**.

For convenience of illustration, an individual socket member 28 is illustrated in FIGS. 6–8, separate from its associated platform 12. This socket member 28 has an elongate body portion 32 made up of three vertically oriented walls 34, 36 and 38, respectively. These walls 34–38 are joined at the lower end by a bottom wall 40, and at their upper end by a circular entry portion 42. This entry portion 42 has a circular rim 44 which joins to a downwardly and inwardly tapering "funnel-like" wall 46 joined to the upper ends of the side walls 34–38.

To describe the manner in which an individual socket member 38 retains a ski pole 47, first it should be noted that a typical ski pole 47 comprises a main pole portion 48, a "basket" 50 near the lower end of the pole portion 48, and a tip portion 52 extending a few inches downwardly from the basket 50. To mount the ski pole 47 into one of the mounting members *22a* or *22b*, the tip portion 52 is pushed into the upper open area defined by the rim 44, with the tapering side wall 46 guiding the tip 52 of the pole 47 downwardly into the elongate opening 54 defined by the three walls 34–38. Two of the side walls 36 and 38 are made with their inner surfaces substantially planar, while the third wall 34 has at its middle portion an element 56 protruding moderately into the opening 54. This protrusion 56 engages the middle part of the tip portion 52 to press it against the two flat surfaces of the walls 36 and 38 and thus hold the ski pole 47 upright. Slots 58 are provided between the three wall members 34–38 to provide a certain amount of "yield" in the wall members 34–38 so that they can grip the tip portions 52 of the poles of varying diameters and hold these poles vertically.

As indicated previously herein, the spacing and arrangement of the mounting members *22a* and *22b* are of particular importance in the present invention. Since ski poles 47 are usually sold in pairs, the upper and lower mounting members *22a* and *22b* are likewise arranged in pairs.

The overall configuration of the spacing of the mounting members *22a* and *22b* is in a generally rectangular pattern, with the members *22a* and *22b* being arranged evenly in both longitudinal and transverse rows. To describe this arrangement further, reference is made to FIG. 2, and more particularly to the platform 12 appearing at the extreme right of FIG. 2. The mounting members *22a* and *22b* are arranged in two transverse rows designated *60a* and *60b*. As shown herein, each row *60a* or *60b* has six pairs of mounting members *22a* and *22b* (three of each), but as will become apparent from the following description, this number could be increased or decreased without impairing the proper functioning of the present invention.

The two mounting members *22a* or *22b* of any single pair are spaced longitudinally from one another. It will be noted that in the row *60a* the three pair of upper mounting members *22a* are arranged in an alternating pattern, with the pairs of lower members *22b* being positioned intermittently with the upper pairs *22a*. Thus, beginning from the top in row *60a*, the first, third and fifth pairs are upper members *22a*, while the second, fourth and sixth pairs are made up of lower members *22b*. With regard to the second row *60b*, the upper and lower pairs *22a* and *22b* are also arranged in an alternating pattern, but in a manner that the upper pairs *22a* in the row *60b* are staggered with respect to the upper pairs *22a* of row *60a*, with the lower pairs *22b* also being staggered with respect to the two rows *60a* and *60b*. Thus, in row *60b*, beginning from top to bottom in the platform at the right side of FIG. 2, the second, third and fourth pairs in row *60b* are made up of upper mounting members *22a*, while the first, third and fifth pairs are made up of lower mounting members *22b*.

Figure 1:
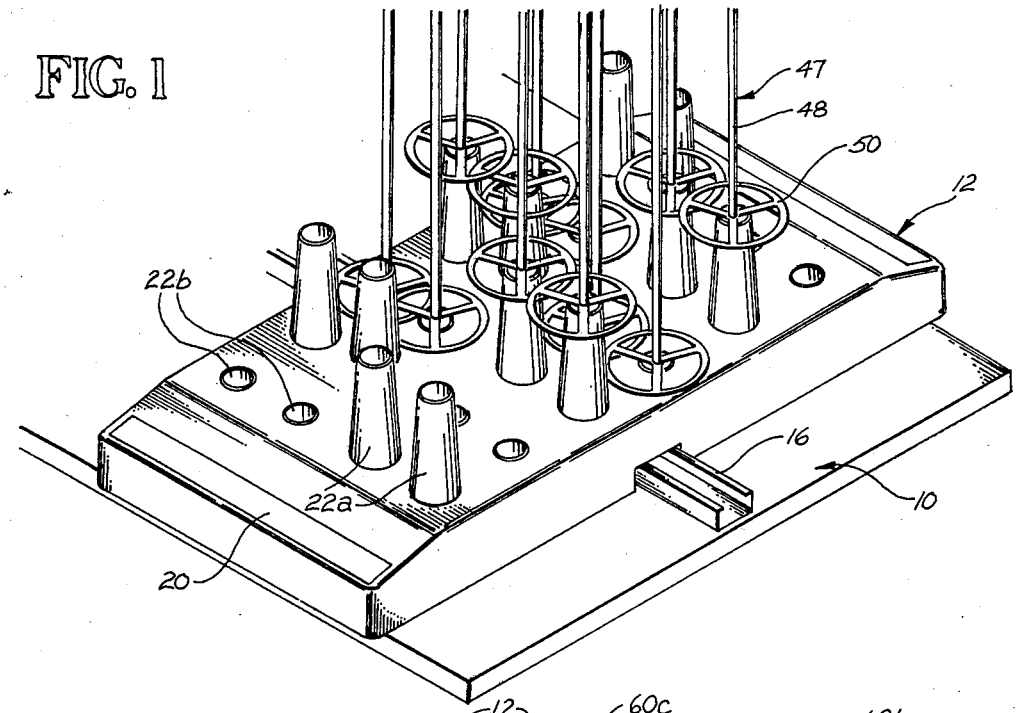
FIG. 1 is an isometric view of one mounting platform of the present invention mounted to its base member.
Figure 2:
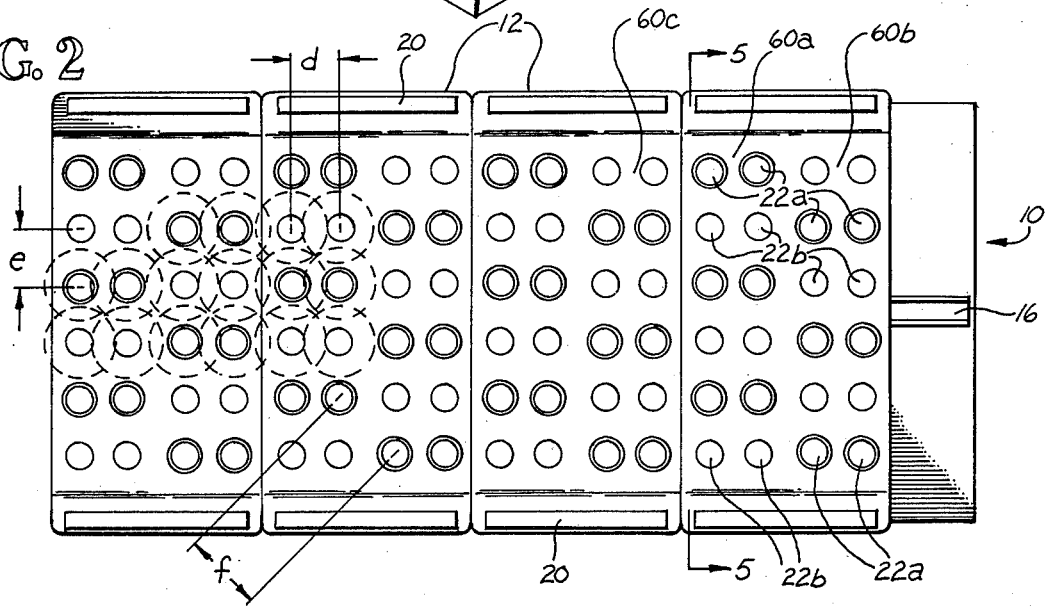
FIG. 2 is a top plan view of the entire mounting assembly of the present invention, made up of a plurality of mounting platforms and a base member.

Likewise, adjacent rows of mounting members *22a* and *22b* of adjacent platforms 12 are arranged in a staggered relationship. As shown in FIG. 2, the row *60c* which is on the adjacent platform 12 and positioned adjacent the row *60a* has its pairs of upper and lower mounting members *22a* and *22b* arranged in the same manner as the row *60b* so that these members *22a* and *22b* in row *60c* are staggered with respect to the adjacent row *60a*. It is readily apparent from an examination of FIG. 2 or FIG. 3 that the same staggered pattern is repeated down through the several platforms 12.

Figure 4:
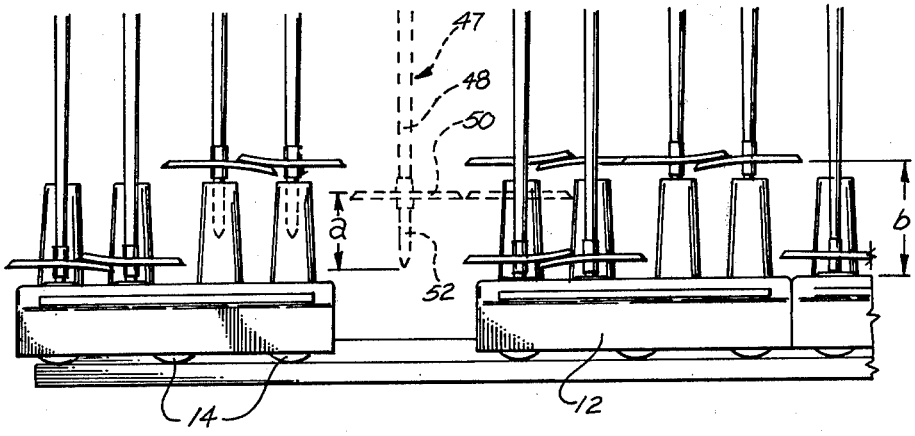
FIG. 4 is a side elevational view of two mounting platforms spaced from one another, illustrating the manner in which a pair of ski poles can be lifted from a pair of lower mounting sockets and removed from the platforms.

With regard to the spacing of the mounting members *22a* and *22b*, reference is made to FIG. 4 to illustrate the vertical spacing of the upper and lower pairs *22a* and *22b*. The dimension from the top of the basket 50 to the bottom of the tip portion 52 on one of the poles 47 is designated as "a". With a pole 47 mounted in an upper mounting member *22a*, the distance between the lower surface of the basket 50 to the top edge of a lower mounting member *22b* is designated as "b". For proper operation of the present invention, it is essential that the dimension "b" be approximately at least as great as the dimension "a", and desirably moderately greater than dimension "a" so as to provide adequate clearance between the baskets 50 of poles 47 mounted in adjacent upper and lower mounting members *22a* and *22b* in the situation where a pair of poles 47 is being removed from a lower pair of mounting members *22b*.

To describe the lateral spacing of the mounting members *22a* and *22b*, reference is again made to FIG. 2. The spacing of the members *22a* and *22b* is substantially equal with respect to both longitudinal and transverse dimensions. Thus, each pair of mounting members *22a* or *22b* forms with an adjacent pair *22b* or *22a* spaced transversely therefrom a square pattern. The spacing of each mounting member *22a* or *22b* in a longitudinal direction is indicated at FIG. 2 at "d", and the longitudinal spacing is indicated at "e". To provide for the maximum density of poles 47 which are supported in each square foot of mounting area, the "d" dimensions and "e" dimensions should be substantially equal. Further, the spacing dimensions "d" and "e" should be moderately greater than the radius of each basket 50, and less than the diameter of each basket 50. This spacing is accomplished in the manner that each pole 47 has its basket 50 overlapping the four baskets 50 immediately adjacent thereto in transverse and longitudinal directions, but has substantially no overlap with the baskets 50 of the poles 47 positioned in mounting members *22a* or *22b* diagonally adjacent to one another. Thus, the dimension between diagonally adjacent members *22a* or *22b*, indicated at "f" in FIG. 2, should be equal to or slightly greater than the diameter of a basket 50.

Figure 3:
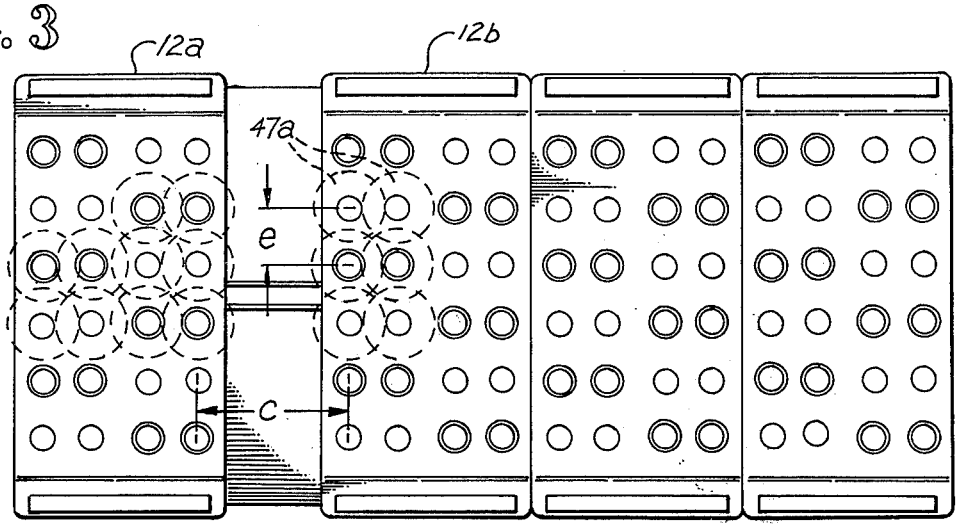
FIG. 3 is a view of the assembly of FIG. 2, with the mounting platforms moved to a second position.

With regard to the spacing between adjacent platforms 12, reference is made to FIG. 3. The platforms 12 should be arranged relative to the base 10, so that any set of adjacent platforms 12 can be moved from one another so that the distance between adjacent mounting members *22a* or *22b* of the two platforms, indicated at "c" in FIG. 3, is approximately equal to twice the diameter of the baskets 50 of the poles 47.

To describe the operation of the present invention, let it be assumed that the mounting assembly is on the floor of a ski shop and ski poles 47 are to be mounted on the platforms 12 for storage and display. Each pair of poles 47 are positioned with the poles generally parallel with the two baskets 50 overlapping. First, pairs of poles 47 are placed in the lower mounting members 22*a* simply by inserting the tips 52 into the upper ends of the socket members 28 of the lower mounting members 22*b*. As indicated previously herein, each socket member 28 is so arranged that the pole 47 is held in an upright position. After the lower mounting members 22*b* have been filled, the remaining pairs of poles 47 are inserted in the socket members 28 of the upper mounting members 22*a*.

With regard to the task of removing poles from the platforms 12, the pairs of poles 47 mounted in the upper mounting members 22*a* are removed simply by pulling that pair of poles 47 straight up. The fact that the two baskets 50 of each pair of poles 47 overlap presents no problem since the two poles 47 of a pair are generally pulled upwardly together. The poles mounted in diagonally adjacent upper mounting members 22*a* are spaced just far enough away so that there is no overlap between the baskets 50 of the diagonally adjacent poles. With regard to the poles mounted in the transversely and longitudinally adjacent lower mounting members 22*b*, these present no problem with respect to removal of poles 47 in the upper mounting members 22*a*, since the baskets 50 of these poles 47 are at a lower location.

To remove the poles 47 mounted in the lower mounting members 22*b*, a somewhat different procedure is followed. With reference to FIG. 3, let it be assumed that a particular pair of lower mounted poles, indicated at 47*a*, is located adjacent the left side of the second platform 12 (counting from left to right). In this instance, this second platform 12 is moved laterally to the right, as seen in FIG. 3, to leave a space between the first and second platforms, indicated as 12*a* and 12*b* in FIG. 3. The pair of poles 47*a* are then moved laterally to the left and at the same time rotated 90° so that the two poles 47*a* are transversely aligned with one another and positioned between the two platforms 12*a* and 12*b*. This location is shown in dotted lines in FIG. 4. With the poles 47*a* so positioned, these two poles can be either moved transversely from between the two platforms 12*a* and 12*b*, or the two poles 47*a* can be lifted and moved transversely from the area between the two platforms 12*a* and 12*b*.

It is to be understood that the above description discloses the details of the preferred embodiment of the present invention, and certain modifications could be made thereto without departing from the broader aspects of the present invention.

What is claimed is:

1. A mounting assembly for pairs of ski poles, each of which has a main pole portion, a basket at the lower end of the pole portion, and a tip portion extending downwardly from the basket, the baskets of each pole having a predetermined radius and diameter, and the tip portions each having a predetermined length, said display assembly comprising:

a. a base member having a longitudinal axis, b. a plurality of platform members mounted to said base for limited movement thereon along said longitudinal axis, each platform member having its own longitudinal axis parallel to the base member longitudinal axis, and a lateral axis generally transverse to its longitudinal axis, c. each platform having thereon pairs of mounting members, each of which has an upper end with an upwardly facing mounting socket of a predetermined depth dimension to receive therein a tip portion of a pole, the pairs of mounting members being arranged in first and second transverse rows, each row being made up of alternate pairs of mounting members and intermediate pairs of mounting members positioned intermittently with the alternate pairs of that row, the alternate pairs of mounting members of the first row being arranged in a staggered relationship with the alternate pairs of the first row being in staggered relationship with the intermediate pairs of the second row, d. said mounting members being arranged in generally longitudinal and transverse alignment, each of said mounting members being spaced from adjacent aligned mounting members by a distance greater than the radius of the baskets and less than the diameter of the baskets, e. the alternate pairs of mounting members having their upper ends at a first upper level above their related platform, and the intermediate pairs of mounting members having their upper ends at a second lower level, said upper and lower levels being spaced from one another a vertical distance such that a vertical dimension from a basket of a pole mounted in one of said upper mounting members to an upper end of an adjacent lower mounting member is at least as great as a distance from an upper surface of a basket to a lower tip end of its related tip portion, whereby ski poles in aligned adjacent mounting members have their baskets in overlapping relationship, with poles in alternate mounting members being able to be moved upwardly free of their mounting members without interference from baskets of adjacent poles, and with poles in intermediate mounting members being able to be moved upwardly free of their related lower mounting members, without interference from baskets in adjacent aligned mounting members of alternate pairs, and then moved longitudinally relative to their related platform to be free of the mounting assembly.

2. The assembly as recited in claim 1, wherein the mounting members of each pair are spaced longitudinally from one another.

3. The assembly as recited in claim 2, wherein said platform members are mounted to said base in a manner that two adjacent platform members can be moved laterally from one another so that adjacent mounting members of the two platform members are spaced from one another at least a distance equal to approximately twice the diameter of the baskets of the poles.

4. The assembly as recited in claim 1, wherein said platform members are mounted to said base in a manner that two adjacent platform members can be moved laterally from one another so that adjacent mounting members of the two platform members are spaced from one another at least a distance equal to approximately twice the diameter of the baskets of the poles.

5. The assembly as recited in claim 1, wherein adjacent rows of mounting members from two adjacent platform members are arranged with the alternate pairs of mounting members of one of said adjacent rows being in staggered relationship with the alternate pairs of mounting members of the other of said adjacent rows, and the intermediate pairs of mounting members of said adjacent rows also being in staggered relationship.

6. The assembly as recited in claim 1, wherein said alternate mounting members are in the form of studs upstanding from an upper surface of their related platform member, and said intermediate mounting members are in the form of studs extending downwardly from said surface of said platform member.

7. The apparatus as recited in claim 1, wherein each of said platforms is provided on at least one side portion thereof with an upwardly facing friction pad to permit engagement of that platform for longitudinal movement along said base.

8. The assembly as recited in claim 1, wherein each of said mounting members comprises a socket portion made up of a plurality of vertically aligned generally planar walls adapted to grip a related tip portion along its length, one of said walls having an inwardly protruding portion to press that tip portion against the other of said walls.

9. The assembly as recited in claim 8, wherein each of said socket members comprises three walls, positioned adjacent one another in a generally triangular configuration, two of said walls having a generally planar configuration to engage its related tip portion along its length, and the other one of which is provided with said inward protrusion.

10. The assembly as recited in claim 9, wherein the three walls of the socket member are joined together at upper and lower ends thereof, and form spacing slots therebetween to permit yielding movement of said walls to yieldingly engage said related tip portion.

11. The assembly as recited in claim 1, wherein:

a. the mounting members of each pair are spaced longitudinally from one another, b. said platform members are mounted to said base in a manner that two adjacent platform members can be moved laterally from one another so that adjacent mounting members of the two platform members are spaced from one another at least a distance equal to approximately twice the diameter of the baskets of the poles, c. adjacent rows of mounting members from two adjacent platform members are arranged with the alternate pairs of mounting members of one of said adjacent rows being in staggered relationship with the alternate pairs of mounting members of the other of said adjacent rows, and the intermediate pairs of mounting members of said adjacent rows also being in staggered relationship, d. said alternate mounting members are in the form of studs upstanding from an upper surface of their related platform member, and said intermediate mounting members are in the form of studs extending downwardly from said surface of said platform member.

12. A mounting device for pairs of ski poles, each of which has a main pole portion, a basket at the lower end of the pole portion, and a tip portion extending downwardly from the basket, the baskets of each pole having a predetermined radius and diameter, and the pole tips each having a predetermined length, said mounting device having a longitudinal axis and a lateral axis transverse to the longitudinal axis, said mounting device comprising:

a. mounting platform, b. a plurality of pairs of mounting members, mounted to said platform, each of which mounting members has an upper end with an upwardly facing mounted socket of a predetermined depth dimension to receive therein a tip portion of a pole, the pairs of mounting members being arranged in first and second transverse rows, each row being made up of alternate pairs of mounting members and intermediate pairs of mounting members positioned intermittently with the alternate pairs of that row, the alternate pairs of mounting members of the first row being arranged in a staggered relationship with the alternate pairs of the second row, and the intermediate pairs of the first row being in staggered relationship with the intermediate pairs of the second row, c. said mounting members being arranged in generally longitudinal and transverse alignment, each of said mounting members being spaced from adjacent aligned mounting members by a distance greater than the radius of the baskets and less than the diameter of the baskets, d. the alternate pairs of mounting members having their upper ends at a first upper level above said platform and the intermediate pairs of mounting members having their upper ends at a second lower level, said upper and lower levels being spaced from one another such that a vertical dimension from a basket of a pole mounted in one of said upper mounting members to an upper end of an adjacent lower mounting member is at least as great as a distance from an upper surface of a basket to a lower tip end of its related tip portion, whereby ski poles in aligned adjacent mounting members have their baskets in overlapping relationship, with poles in alternate mounting members being able to be moved upwardly free of their mounting members without interference from baskets of adjacent poles, and with poles in intermediate mounting members being able to be moved upwardly free of their related lower mounting members, without interference from baskets in adjacent aligned mounting members of alternate pairs, and then moved longitudinally relative to said platform to be free of the mounting device.

13. The apparatus as recited in claim 12, wherein the mounting members of each pair are spaced longitudinally from one another.

14. The apparatus as recited in claim 12, wherein said alternate mounting members are in the form of studs upstanding from an upper surface of said platform, and said intermediate mounting members are in the form of studs extending downwardly from said surface of said platform.

15. The apparatus as recited in claim 12, wherein each of said mounting members comprises a socket portion made up of a plurality of vertically aligned generally planar walls adapted to grip a related tip portion along its length, one of said walls having an inwardly protruding portion to press that tip portion against the other of said walls.

16. The apparatus as recited in claim 15, wherein each of said socket members comprises three walls, positioned adjacent one another in a generally triangular configuration, two of said walls having a generally planar configuration to engage its related tip portion along its length, and the other one of which is provided with said inward protrusion.

17. The apparatus as recited in claim 16, wherein the three walls of the socket member are joined together at upper and lower ends thereof, and form spacing slots therebetween to permit yielding movement of said walls to engage said tip portion of the ski pole.

18. A mounting device for ski poles, each of which has a main pole portion, a basket at the lower end of the pole portion, and a tip portion extending downwardly from the basket, the baskets of each pole having a predetermined radius and diameter, and the tip portions each having a predetermined length, said mounting device having a longitudinal axis and a lateral axis transverse to the longitudinal axis, said mounting device comprising:

a. a mounting platform, b. two sets of mounting members which are mounted to said platform, each mounting member having an upper end with an upwardly facing mounting socket of a predetermined depth dimension to receive therein a tip portion of a pole, the mounting members of the first set having their upper ends at a first upper level above said platform, and the mounting members of the second set having their upper ends at a second lower level, said upper and lower levels being spaced from one another such that a vertical dimension from a basket of a pole mounted in one of said upper mounting members to an upper end of an adjacent lower mounting member is at least as great as a distance from an upper surface of a basket to a lower tip end of its related tip portion, c. said mounting members being arranged in two generally parallel rows, with the mounting members of the first and second sets being positioned in each row alternately with one another along the length of the row, and with the mounting members of the first set being in staggered relationship with one another along the length of the two rows, and the mounting members of the second set also being in staggered relationship with one another along the length of the two rows, d. said mounting members being arranged in generally longitudinal and transverse alignment, each of said mounting members being spaced from adjacent aligned mounting members by a distance greater than the radius of the baskets and less than the diameter of the baskets, whereby ski poles in aligned adjacent mounting members have their baskets in overlapping relationship, with poles in the first set of mounting members being able to be moved upwardly free of their mounting members without interference from baskets of adjacent poles, and with poles in the mounting members of the second set being able to be moved upwardly free of their related mounting members of the second set, without interference from baskets in mounting members of the first set, and then moved longitudinally relative to said platform to be free of the mounting device.

19. The apparatus as recited in claim 18, wherein the mounting members of the first set are in the form of studs upstanding from an upper surface of said platform, and the mounting members of the second set are in the form of studs extending downwardly from the surface of the platform.

20. A method of mounting a group of pairs of ski poles and removing said ski poles from their mounting locations, each of which ski poles has a main pole portion, a basket at the lower end of the pole portion, and a tip portion extending downwardly from the basket, the baskets of each pole having a predetermined radius and diameter, and the tip portions each having a predetermined length, said method comprising:

a. mounting pairs of ski poles in related pairs of mounting members, each of which has an upper end with an upwardly facing mounting socket of a predetermined depth dimension to receive therein a tip portion of a pole, the pairs of mounting members being arranged in first and second transverse rows, each row being made up of alternate pairs of mounting members and intermediate pairs of mounting members positioned intermittently with the alternate pairs of that row, the alternate pairs of mounting members of the first row being arranged in a staggered relationship with the alternate pairs of the second row, and the intermediate pairs of the first row being in staggered relationship with the intermediate pairs of the second row, b. said ski poles being mounted in generally longitudinal and transverse alignment, so that each of said mounting members is spaced from adjacent aligned mounting members by a distance greater than the radius of the baskets and less than the diameter of the baskets, with alternate pairs of mounting members having their upper ends at a first upper level above their related platform, and the intermediate pairs of mounting members having their upper ends at a second lower level, said upper and lower levels being spaced from one another such that a vertical dimension from a basket of a pole mounted in one of said upper mounting members to an upper end of an adjacent lower mounting member is at least as great as a distance from an upper surface of a basket to a lower tip end of its related tip portion, c. removing poles in alternate mounting members by moving these poles upwardly free of their mounting members without interference from baskets of adjacent poles, and d. removing poles in intermediate mounting members by moving these poles upwardly free of their related lower mounting members, without interference from baskets in adjacent aligned mounting members of alternate pairs, and then moving these poles longitudinally relative to the remaining poles.

21. The method as recited in claim 20, wherein each pair of poles is mounted with the two poles of that pair spaced longitudinally from one another.

22. The method as recited in claim 20, wherein said group of ski poles is mounted to a first platform carrying said mounting members, and a second group of ski poles is mounted to a second platform in the same manner as the first group, said method further comprising moving said first and second platforms longitudinally from one another to permit removal of ski poles mounted in adjacent rows from said two platforms.

23. The method as recited in claim 22, wherein adjacent rows of mounting members from said two adjacent platform members are arranged with the alternate pairs of mounting members of one of said adjacent rows being in staggered relationship with the alternate pairs of mounting members of the other of said adjacent rows, and the intermediate pairs of mounting members of said adjacent rows also being in staggered relationship.

24. A method of mounting a plurality of groups of pairs of ski poles and removing selected pairs from their mounting locations, each of which ski poles has a main pole portion, a basket at the lower end of the pole portion, and a tip portion extending downwardly from the basket, the baskets of each pole having a predetermined radius and diameter, and the tip portions of each having a predetermined length, said method comprising:

a. providing a base member having a longitudinal axis, b. providing a plurality of platform members mounted to said base for limited movement thereon along said longitudinal axis, each platform member having its own longitudinal axis parallel to the base member longitudinal axis, and a lateral axis generally transverse to its longitudinal axis, c. providing on each platform pairs of mounting members, each of which has an upper end with an upwardly facing mounting socket of a predetermined depth dimension to receive therein a tip portion of a pole, the pairs of mounting members being arranged in first and second transverse rows, each row being made up of alternate pairs of mounting members and intermediate pairs of mounting members positioned intermittently with the alternate pairs of that row, the alternate pairs of mounting members of the first row being arranged in a staggered relationship with the alternate pairs of the second row, and the intermediate pairs of the first row being in staggered relationship with the intermediate pairs of the second row, d. providing said mounting members in generally longitudinal and transverse alignment, each of said mounting members being spaced from adjacent aligned mounting members by a distance greater than the radius of the baskets and less than the diameter of the baskets, e. providing the alternate pairs of mounting members with their upper ends at a first upper level above their related platform, and the intermediate pairs of mounting members with their upper ends at a second lower level, said upper and lower levels being spaced from one another such that the vertical dimension from a basket of a pole mounted in one of said upper mounting members to an upper end of an adjacent lower mounting member is at least as great as a distance from an upper surface of a basket to a lower tip end of its related tip portion, f. mounting pairs of ski poles in related pairs of mounting members with the baskets of the poles in overlapping relationship, g. removing selected poles which are mounted in the alternate mounting members by moving these poles upwardly free of their mounting members without interference from baskets of adjacent poles, and h. removing selected poles from said intermediate mounting members by first moving these poles upwardly free of their related lower mounting members, without interference from baskets in adjacent aligned mounting members of alternate pairs, and then moving these poles longitudinally relative to their related platform to be free of the mounting assembly.

25. The method as recited in claim 24, further comprising mounting poles of each pair longitudinally spaced from one another.

26. The method as recited in claim 25, further comprising arranging said platform members on said base member in a manner that two adjacent platform members can be moved laterally from one another so that adjacent mounting members of the two platform members are spaced from one another at least a distance equal to approximately twice the diameter of the baskets of the poles, and then removing selected pairs of poles from intermediate pairs of mounting members by moving said pairs of poles laterally into an open area between longitudinally spaced platforms.

27. The method as recited in claim 24, further comprising providing adjacent rows of mounting members from two adjacent platform members with the alternate pairs of mounting members of one of said adjacent rows in staggered relationship with the alternate pairs of mounting members of the other of said adjacent rows, and the intermediate pairs of mounting members of said adjacent rows also in staggered relationship.

28. A mounting device for pairs of ski poles, each of which has a main pole portion, a basket at the lower end of the pole portion, and a tip portion extending downwardly from the basket, the baskets of each pole having a predetermined radius and diameter, and the pole tips each having a predetermined length, said mounting device having a longitudinal axis and a lateral axis transverse to the longitudinal axis, said mounting device comprising:

a. a mounting platform, b. a plurality of pairs of mounting members, mounted to said platform, each of which mounting members has an upper end with an upwardly facing mounting socket of a predetermined depth dimension to receive therein a tip portion of a pole, the pairs of mounting members being arranged in at least one transverse row, said row being made up of alternate pairs of mounting members and intermediate pairs of mounting members positioned intermittently with the alternate pairs of that row, c. said mounting members being arranged in generally longitudinal and transverse alignment, each of said mounting members being spaced from adjacent aligned mounting members by a distance greater than the radius of the baskets and less than the diameter of the baskets, d. the alternate pairs of mounting members having their upper ends at a first upper level above said platform and the intermediate pairs of mounting members having their upper ends at a second lower level, said upper and lower levels being spaced from one another such that a vertical dimension from a basket of a pole mounted in one of said upper mounting members to an upper end of an adjacent lower mounting member is at least as great as a distance from an upper surface of a basket to a lower tip end of its related tip portion, whereby ski poles in aligned adjacent mounting members have their baskets in overlapping relationship, with poles in alternate mounting members being able to be moved upwardly free of their mounting members without interference from baskets of adjacent poles, and with poles in intermediate mounting members being able to be moved upwardly free of their related lower mounting members, without interference from baskets in adjacent aligned mounting members of alternate pairs, and then moved longitudinally relative to said platform to be free of the mounting device.

29. A mounting assembly for pairs of ski poles, each of which has a main pole portion, a basket at the lower end of the pole portion, and a tip portion extending downwardly from the basket, the baskets of each pole having a predetermined radius and diameter, and the tip portions each having a predetermined length, said display assembly comprising:

a. a base member having a longitudinal axis, b. a plurality of platform members mounted to said base for limited movement thereon along said longitudinal axis, each platform member having its own longitudinal axis parallel to the base member longitudinal axis, and a lateral axis generally transverse to its longitudinal axis, c. each platform having thereon pairs of mounting members, each of which has an upper end with an upwardly facing mounting socket of a predetermined depth dimension to receive therein a tip portion of a pole, the pairs of mounting members being arranged in at least one transverse row, each row being made up of alternate pairs of mounting members and intermediate pairs of mounting members positioned intermittently with the alternate pairs of that row, d. said mounting members being arranged in generally longitudinal and transverse alignment, each of said mounting members being spaced from adjacent aligned mounting members by a distance greater than the radius of the baskets and less than the diameter of the baskets, e. The alternate pairs of mounting members having their upper ends at a first upper level above their related platform, and the intermediate pairs of mounting members having their upper ends at a second lower level, said upper and lower levels being spaced from one another a vertical distance such that a vertical dimension from a basket of a pole mounted in one of said upper mounting members to an upper end of an adjacent lower mounting member is at least as great as a distance from an upper surface of a basket to a lower tip end of its related tip portion, whereby ski poles in aligned adjacent mounting members have their baskets in overlapping relationship, with poles in alternate mounting members being able to be moved upwardly free of their mounting members without interference from baskets of adjacent poles, and with poles in intermediate mounting members being able to be moved upwardly free of their related lower mounting members, without interference from baskets in adjacent aligned mounting members of alternate pairs, and then moved longitudinally relative to their related platform to be free of the mounting assembly.

30. The assembly as recited in claim 29, wherein the mounting members of each pair are spaced longitudinally from one another.

31. The assembly as recited in claim 30, wherein said platform members are mounted to said base in a manner that two adjacent platform members can be moved laterally from one another so that adjacent mounting members of the two platform members are spaced from one another at least a distance equal to approximately twice the diameter of the baskets of the poles.

32. The assembly as recited in claim 29, wherein said platform members are mounted to said base in a manner that two adjacent platform members can be moved laterally from one another so that adjacent mounting members of the two platform members are spaced from one another at least a distance equal to approximately twice the diameter of the baskets of the poles.

33. The assembly as recited in claim 29, wherein adjacent rows of mounting members from two adjacent platform members are arranged with the alternate pairs of mounting members of one of said adjacent rows being in staggered relationship with the alternate pairs of mounting members of the other of said adjacent rows, and the intermediate pairs of mounting members of said adjacent rows also being in staggered relationship.

34. The assembly as recited in claim 29, wherein said alternate mounting members are in the form of studs upstanding from an upper surface of their related platform member, and said intermediate mounting members are in the form of studs extending downwardly from said surface of said platform member.

35. The apparatus as recited in claim 29, wherein each of said platforms is provided on at least one side portion thereof with an upwardly facing friction pad to permit engagement of that platform for longitudinal movement along said base.

36. The assembly as recited in claim 29, wherein each of said mounting members comprises a socket portion made up of a plurality of vertically aligned generally planar walls adapted to grip a related tip portion along its length, one of said walls having an inwardly protruding portion to press that tip portion against the other of said walls.

37. The assembly as recited in claim 36, wherein each of said socket members comprises three walls, positioned adjacent one another in a generally triangular configuration, two of said walls having a generally planar configuration to engage its related tip portion along its length, and the other one of which is provided with said inward protrusion.

38. The assembly as recited in claim 37, wherein the three walls of the socket member are joined together at upper and lower ends thereof, and form spacing slots therebetween to permit yielding movement of said walls to yieldingly engage said related tip portion.

39. The assembly as recited in claim 29, wherein:

a. the mounting members of each pair are spaced longitudinally from one another, b. said platform members are mounted to said base in a manner that two adjacent platform members can be moved laterally from one another so that adjacent mounting members of the two platform members are spaced from one another at least a distance equal to approximately twice the diameter of the baskets of the poles, c. adjacent rows of mounting members from two adjacent platform members are arranged with the alternate pairs of mounting members of one of said adjacent rows being in staggered relationship with the alternate pairs of mounting members of the other of said adjacent rows, and the intermediate pairs of mounting members of said adjacent rows also being in staggered relationship, d. said alternate mounting members are in the form of studs upstanding from an upper surface of their related platform member, and said intermediate mounting members are in the form of studs extending downwardly from said surface of said platform member.

* * * * *